United States Patent [19]

Krietemeier et al.

[11] 4,325,996

[45] Apr. 20, 1982

[54] ARTIFICIAL BIRD AND METHOD OF MAKING SAME

[76] Inventors: Rickie F. Krietemeier, 6311 S. Florence Way, Englewood, Colo. 80111; Gary D. Davis, 7930 E. Edgewood Dr., Indianapolis, Ind. 46239

[21] Appl. No.: 171,746

[22] Filed: Jul. 24, 1980

[51] Int. Cl.[3] ..... A41G 9/00; A63H 33/16

[52] U.S. Cl. ..... 428/16; 428/6; 428/102

[58] Field of Search ..... 428/6, 16, 102; 46/124; 43/2, 3; 156/61

[56] References Cited

U.S. PATENT DOCUMENTS

| | | | |
|---|---|---|---|
| 290,679 | 12/1883 | Greig | 428/16 |
| 1,445,362 | 2/1923 | Schwarzkopf | 46/124 X |
| 1,652,775 | 12/1927 | Funk et al. | 428/16 X |
| 1,793,734 | 2/1931 | Cole | 428/16 |
| 3,435,550 | 4/1969 | Carlson | 43/3 |
| 3,800,457 | 4/1974 | Barrett | 428/16 X |
| 4,048,749 | 9/1977 | Zitting et al. | 46/124 X |

FOREIGN PATENT DOCUMENTS

| | | | |
|---|---|---|---|
| 911100 | 11/1962 | United Kingdom | 428/6 |

*Primary Examiner*—Henry F. Epstein
*Attorney, Agent, or Firm*—John E. Reilly

[57] ABSTRACT

An artificial bird is comprised of a molded body consisting of the trunk, legs, neck and head; feet are secured to the legs, and the body is covered with feathers by applying a series of patterns to the body to which are attached rows of feathers to cover the legs and stomach, breast, back, neck and head. A pattern of wing feathers is affixed to a thin but fairly rigid base of air foil configuration, the wing feathers being secured by connecting rods to the sides of the body. A pattern of tail feathers arranged in rows is preassembled and formed to lend the desired configuration to the tail.

16 Claims, 8 Drawing Figures

ARTIFICIAL BIRD AND METHOD OF MAKING SAME

This invention relates to the manufacture of artificial birds and more particularly to the manufacture of replicas of the bald and golden eagle to take on the appearance of a real or mounted eagle.

BACKGROUND OF THE INVENTION

While mounting or stuffing of birds is in widespread use in the field of taxidermy, the making of artificial birds to take on the appearance of real birds has presented a number of difficulties, particularly in the arrangement and mounting of the feather portions.

This problem is particularly acute in simulating the appearance of the bald and golden eagle which by government law cannot be killed or mounted. Morover, the sale of eagle feathers is prohibited under the law.

By careful selection of feathers from other birds and cutting or contouring to the proper shape, it is possible to closely duplicate those of the eagle or other birds; and if properly arranged and mounted, make it possible to closely duplicate the appearance of a specific bird. It will be appreciated, however, that individual selection and contouring of feathers and their application to a form or body can be very tedious and time-consuming so as to make it impractical to produce such birds in any quantities.

It is therefore an object of the present invention to provide for a novel and improved method and means for the fabrication of artificial birds which will closely duplicate the appearance of real birds and in such a way as to make it feasible to produce artificial birds in mass quantities.

A further object of the present invention is to provide for a novel and improved form or mold which will greatly facilitate mass production of artificial birds; and further wherein a distinct arrangement of feather patterns is employed in combination with the form to facilitate the assembly and mass production of birds.

It is an additional object of the present invention to provide for a novel and improved artificial bird and method of making same which will permit production in mass quantities with individual variation in wing disposition or spread and mounting of the bird itself.

SUMMARY OF THE INVENTION

In accordance with a preferred form of the present invention, an eagle is formed by fabricating the trunk or body as well as the legs and outline of the neck and head in a mold, such as, by casting out of polyurethane into the desired configuration. Bores are formed through the center of the legs, sockets are formed in the head for placement of the eyes and a minimum of handwork is required as a preliminary to application of the extremities.

The claws or feet are releasably secured to each of the legs by means of lag bolts inserted through openings in each foot and anchored in place in upwardly extending relation through aligned bores in each of the legs. The claws or feet may be attached to a suitable pedestal such as a log or rock and the upper end of the bolt may be bonded within the center bore of each of the legs.

The feathers are composed of natural and dyed feathers of goose, turkey, rooster and duck of differing lengths which are arranged in rows and extend in horizontal courses in overlapping relation to one another.

The feathers are sewn to patterns superimposed in rows and the patterns are secured to the head and neck, body, wings, legs and tail. The patterns secured to the body are specially contoured to cover the breast, back, legs and neck. The wing patterns are applied to a rigid base plate of generally air-foil configuration which is secured in the desired relation to the body by connecting rods or bolts extending through opposite side openings in the body. The feathered wing patterns are applied to each plate and consist of a series of rows arranged in horizontal courses along the length and breadth of each plate, the lower edges of each feathered row partially overlapping the upper edges of each next feathered lower row in succession. The wings may be applied so as to extend along the body or to be spread at different angles from the body.

The tail section may be formed by individually securing to the tail section of the form; or by applying a preassembled pattern of feathers to a pliable base plate having a reduced end, the base plate and preassembled pattern attached to the lower end of the back portion of said body in bonded relation. The base plate may then be formed to the desired configuration so that the feathers extend at the desired angle, i.e. in a manner such that a plurality of rows of feathers are arranged in horizontal relation for the entire width and breadth of the pliable base plate.

Above the neck pattern of feathers additional white feathers may be individually placed to overlap the pattern. Each of the feather patterns is made by temporarily sticking the feathers in rows, such as by taping, then double-stitching to the base pattern made of cloth. The bird is completed by painting the head and inserting the eyes.

The above and other objects, advantages and features of the present invention will become more readily appreciated and understood from the foregoing detailed description of a preferred embodiment when taken together with the accompanying drawings, in which:

DETAILED DESCRIPTION OF THE PREFERRED EMBODIMENT

Figure 1:
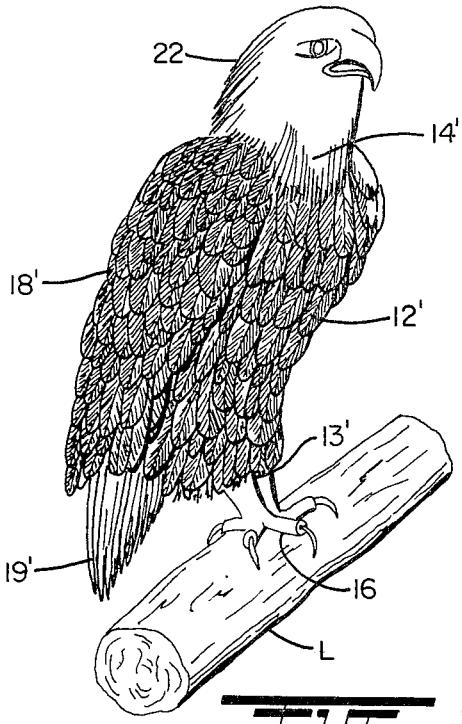
FIG. 1 is a perspective view of a preferred embodiment illustrating a golden eagle formed in accordance with the present invention.
Figure 2:
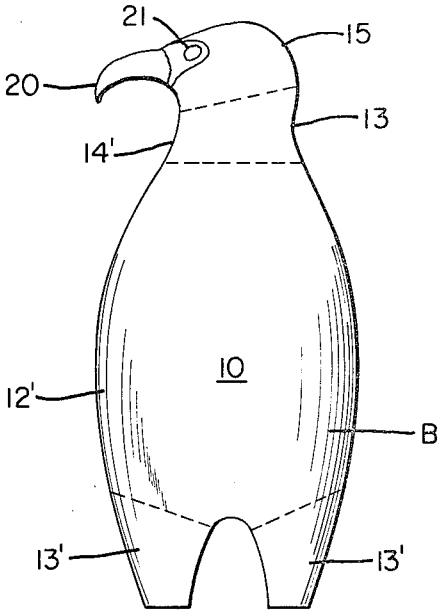
FIG. 2 is a front view of the body section illustrating the placement of patterns in the preferred form of the present invention.

Referring in detail to the drawings, FIGS. 1 to 7 illustrate the construction and method of forming a golden eagle, the completed form of bird being illustrated in FIG. 1. Broadly, the eagle is comprised of a solid, molded body 10 which may, for example, be cast out of polyurethane into a body which is made up of a trunk or midsection 12, downwardly extending spaced legs 13, upwardly convergent neck 14 and head 15. Claws or feet 16 are releasably secured to the legs and may be attached to a suitable pedestal, such as, a log L so as to support the bird in upright relation. A special series of feather patterns are made to cover each section of the bird and specifically comprises a breast pattern as designated at 12', right and left leg patterns designated at 13', neck pattern 14', back pattern 17' and wing patterns 18', together with tail pattern 19'. The head 15 is completed by insertion of eyes 21 into sockets formed in the head and painting to the desired color. Individual neck feathers may be applied over the pattern of neck feathers by bonding to the mold, the individual neck feathers being generally represented at 22.

Figure 5:
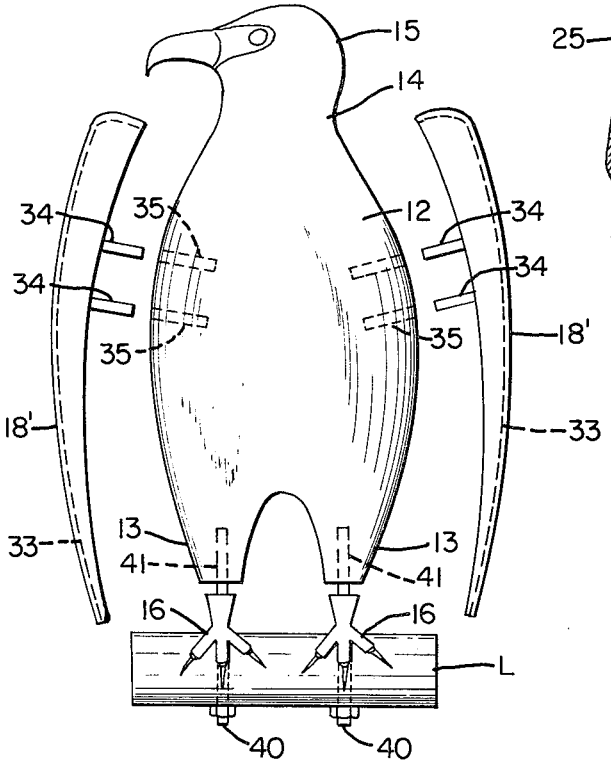
FIG. 5 is a somewhat exploded front view illustrating in particular the attachment of the wing and feet portions.
Figure 6:
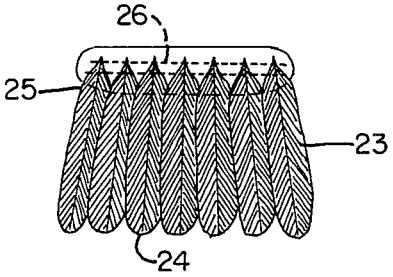
FIG. 6 is a detailed view of a single row of feathers employed in forming the tail section.
Figure 4:
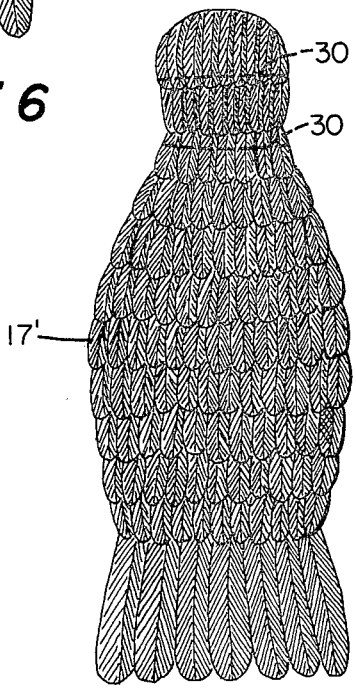
FIG. 4 is rear view of the preferred form of invention showing the pattern or arrangement of feathers along the back and tail.
Figure 7:
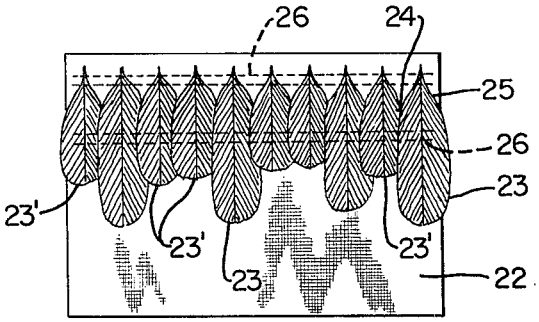
FIG. 7 is a detailed view illustrating the arrangement and pattern of feathers formed on a pattern.
Figure 3:
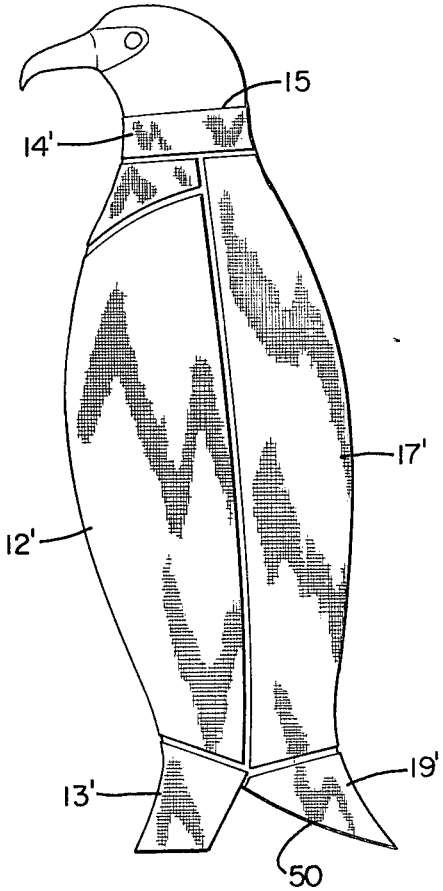
FIG. 3 is a side view of the body section and arrangement of the patterns thereon.

Considering in more detail the construction and arrangement of the present invention, most critical to the formation of a bird which will simulate a real bird and particularly to lend itself to mass production or production in quantities is the preassembly and arrangement of the feather patterns as described. Referring for example to FIGS. 4 and 5, each feather pattern comprises a base of cotton cloth which is made to correspond to the dimensions of the breast and back of the body, wings, legs, head and tail, the base being designated at 22 in FIG. 7 and serving as the matrix for the application of feathers. The feathers are selected from natural and dyed goose, turkey, rooster and duck feathers and are applied in rows so that, as shown in FIG. 7, each row is comprised of alternate long and short feathers 23 and 23', respectively, arranged in parallel relation to one another with their side edges slightly overlapping as designated at 24 and upper ends 25 being aligned and temporarily secured, such as, by taping to the matrix 22 as indicated at 26 to the pattern. Permanent attachment is then accomplished by a machine sewing operation with the feathers arranged somewhat along a straight line in each row as shown. Each next lower row in succession is correspondingly made up of long and short feathers sewn to the matrix beneath the next upper row so that each upper row overlaps each next lower row in succession. The appearance of the feather pattern is further enhanced by making up each row with one short, one long, two short, one long, two short, one long, followed by one short, one long feather in succession thereacross as represented in FIG. 7.

Again, a series of rows of feathers are arranged on each pattern such that the lower ends of the upper row of feathers slightly overlap the attached ends of the next row so as to completely cover or hide their lines of attachment. Each attaching row as illustrated in FIG. 4 will assume or follow a somewhat arcuate or curved line when the patterns are applied to the rounded contour of the form, as represented by the dotted lines 30 in FIG. 4. Generally, it will be observed that the length of the feathers making up the neck and the leg patterns are much shorter than those comprising the breast and back patterns. Once the patterns are completed, they are applied by bonding or gluing to the body with the breast pattern extending laterally around approximately one-half of the bird and the back pattern extending laterally around the opposite half, as seen from a consideration of FIGS. 2 and 6. Both the neck and leg patterns are designed to fully encircle the neck and legs, respectively, of the bird with the lowermost row of feathers on the breast and back overlapping the uppermost rows of feathers on the legs; and similarly the lowermost row of feathers in the neck slightly overlap the uppermost row of feathers on the back and breast.

Figure 8:
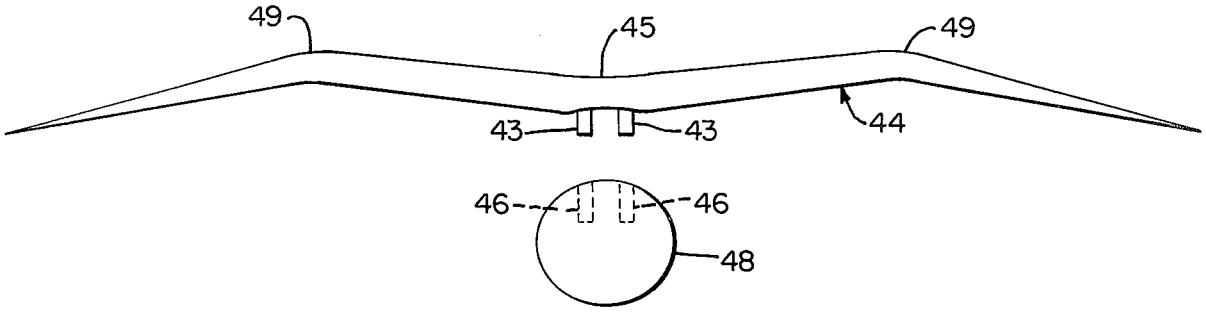
FIG. 8 is an exploded view of an alternate form of wing placement in the spread position.

A special technique is employed for making of the wings designated at 32 in FIGS. 1 and 5, the wings being preassembled and specially constructed for attachment to the body. Specifically, each wing section comprises a rigid base plate 33 of generally arcuate configuration and slightly curved so as to be of somewhat concavo convex configuration in a lengthwise direction and having inwardly projecting, upper and lower spaced pins 34 adapted and aligned for insertion with sockets 35 on opposite sides of the body. The base plates may for example be comprised of rigid Fiberglas or metal and their outer convex surfaces are covered with a preassembled pattern of feathers made in a manner corresponding to that described with respect to the other patterns and therefore consisting of a series of superimposed rows of feathers as indicated at 36 extending along the full length beginning from a point designated at 36' at the uppermost inner edge of the convex surface and proceeding over then downwardly along the external surface of the wing. Further, the wings are each dimensioned to be of a length to traverse the full length of the bird from the neck to a point projecting downwardly just beyond the claws or feet 16 when the wings are attached in the relationship shown in FIGS. 1 and 5. It will be apparent, however, that the wings may be directed at different angles, such as, at a rearward or outward angle simply by modifying the placement of pins 34 as well as the complementary sockets 35. This is exemplified by the spread-wing arrangement shown in FIG. 8 wherein a single wing span is made up of a base plate 44 with a common center connecting portion 45 provided with laterally spaced, downwardly projecting pins 43 adapted for insertion into the sockets 46 in the upper back of the body or form 48. Extending away from the center portion 45 are oppositely directed wing sections 49 of broad, inverted V-shaped configuration so as to simulate the actual appearance of the eagle. In a manner corresponding to that hereinbefore described with reference to FIG. 1, a wing feather pattern is applied to the common base plate 44.

The feet 16 are secured to the legs 13 preferably by means of lag bolts 40 which pass upwardly through openings 41 in each of the respective feet and are anchored in place within bores 42 formed in the legs 13, such as, by means of a bonding agent inserted into the bores. Preferably, each of the feet and legs are composed of an aluminum-filled, mass-casted epoxy resin, and the resin is applied over the claws which are preferably made up of a series of three rods 44 around which the epoxy resin is cast. While the feet may be secured to any suitable form of pedestal, again as illustrated in FIG. 5, the lag bolts are preferably passed upwardly through openings in the log L, then through the aligned openings and bores formed respectively in the feet and legs so as to unite the pedestal feet and legs together.

The bird as formed is composed of mass-produced components united together into an integrated assembly. The balance of the operations are individual or custom operations for the most part and consist of completion of the neck and head portions. Thus, the tail pattern is individually preassembled, for example, in the manner illustrated in FIG. 5, with its uppermost row glued onto the body with the lower edge of the back pattern superimposed over the upper row of feathers. The tail section 50 of the body 10 is downwardly and rearwardly tapered so as to lend the proper configuration to the tail feather pattern when applied thereto. The upper neck section and crown 50 of the head are completed by individually applying feathers which are preferably individually glued as represented at 22 in rows along the upper neck and crown of the head. In the preferred form, the neck pattern of feathers comprises white feathers, such as, maribou feathers, individually placed to partially overlap the upper of feathers on the neck pattern 14. The bird is then completed by inserting the eyes 21 into sockets in a wellknown manner and painting or dying the head to the desired color. Individual shaping may be done for the beak and nostrils of the bird, such as, by application of Fiberglas into the desired shape over the molded outline of the head.

In the formation of the golden eagle, for the most part the feathers making up the back pattern are goose feathers, those making up the breast pattern are also goose feathers; those making up the neck pattern may be a combination of rooster and strung feathers except for the upper row which is composed of maribou feathers; and the leg feathers are preferably goose feathers while the wing and tail feathers are preferably goose and turkey. The replica of the bird thus formed bears a striking resemblance to the golden eagle.

Although the present invention has been described with particularity relative to the foregoing detailed description of the preferred embodiment, various modifications, changes, additions and applications other than those specifically mentioned herein will be readily apparent to those having normal skill in the art without departing from the spirit and scope of this invention.

I claim:

1. A replica of a bird comprising in combination:

a molded body consisting of a trunk, legs, neck and head;

feet secured to each of the legs, and a feathered wing section secured to said body said wing section having a base plate and interconnecting means extending from said base plate for interconnecting said wing section to said body; and feather patterns for each of said feathered wing section, trunk and legs of said molded body, each feathered pattern comprising a flexible matrix and series of rows of individual feathers arranged to extend in horizontal courses with the feathers in each row partially overlapping the feathers in each next row in succession, and means for applying each of said feathered patterns in place on said matrix.

2. In a replica of a bird according to claim 1, there being a pair of preassembled wing sections each comprising a rigid base plate to which said feather patterns are applied and said interconnecting means defined by pin members extending substantially normal to said base plate for interconnecting said wing sections to opposite sides of said body.

3. In a replica of a bird according to claim 2, said rigid base plate provided with spaced inwardly projecting pins adapted for insertion into sockets formed in opposite sides of said body.

4. In a replica of a bird according to claim 2, each of said feathered wing sections comprising a rigid base plate of generally air-foil configuration and a feather pattern applied to each plate having a series of rows arranged in courses along the entire length and breadth of each base plate, the lower edges of individual feathers in each row overlapping the upper edges of individual feathers in each next lower row in succession.

5. In a replica of a bird according to claim 1, including a pattern of preassembled tail feathers consisting of a pliable base member and a plurality of rows of feathers arranged in courses for the entire length and breadth of said pliable base member.

6. In a replica of a bird according to claim 1, said feet releasably secured to said legs and having claw portions and a lag bolt inserted through openings in each foot and extending upwardly through an aligned bore in each of said respective legs.

7. In a replica of a bird according to claim 1, said wing section secured to the back of said body for extension in opposite directions therefrom.

8. In a replica of a bird according to claim 7, said wing section having a common center connecting portion.

9. In a replica of a bird according to claim 1, said body having a downwardly and rearwardly tapered tail portion adapted for the application of feathers thereto.

10. In a replica of a bird wherein a molded body includes a trunk, legs, neck and head and feet releasably secured to each of the legs, and a wing section is releasably secured to said body, the improvement comprising:

feather patterns for each of said wing section, trunk, neck and leg portions, each feathered pattern comprising a matrix and a series of rows of feathers arranged to extend in courses along said matrix with the feathers in each row partially overlapping the feathers in each next row in succession, the feathers in each row consisting of individual feathers of differing lengths; and means for applying each of said feathered patterns in place on said wing section, trunk, neck and leg portions.

11. In a replica of a bird according to claim 10, said wing section having spaced, inwardly projecting pin members adapted for insertion into sockets formed in said body.

12. In a replica of a bird according to claim 10, each of said feather rows comprising alternate long and short feathers arranged in partially overlapping relation to one another.

13. In a replica of a bird according to claim 10, including a pattern of preassembled tail feathers and a plurality of rows of feathers arranged in courses for the entire length and breadth thereof.

14. In a replica of a bird according to claim 10, said feet having claw portions and a lag bolt inserted through openings in each foot and extending upwardly through an aligned bore in each of said respective legs.

15. In a replica of a bird according to claim 10, including means for securing one end of each feather to said matrix.

16. In a replica of a bird according to claim 15, said matrix being composed of a cloth material, and said securing means defined by an adhesive tape to releasably secure the ends of said feathers in each row to said cloth material and stitching to permanently secure said ends of said feather in each row to said cloth material.

* * * * *